US007628858B2

(12) United States Patent
Higaki et al.

(10) Patent No.: US 7,628,858 B2
(45) Date of Patent: Dec. 8, 2009

(54) COATING FILM FORMING APPARATUS, ELECTROPHOTOGRAPHIC FIXING MEMBER FORMED BY COATING FILM APPARATUS, AND IMAGE FORMING APPARATUS HAVING ELECTROPHOTOGRAPHIC FIXING MEMBER

(75) Inventors: Michitaka Higaki, Atsugi (JP); Takayuki Yoshii, Yokohama (JP); Satoshi Tohkai, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/005,514

(22) Filed: Dec. 27, 2007

(65) Prior Publication Data

US 2008/0156259 A1 Jul. 3, 2008

(30) Foreign Application Priority Data

Dec. 28, 2006 (JP) ..... 2006-356389

(51) Int. Cl.
*B05B 3/00* (2006.01)

(52) U.S. Cl. ..... 118/323; 118/DIG. 11

(58) Field of Classification Search ..... 118/63, 118/410, DIG. 11, DIG. 18, DIG. 19, DIG. 12, 118/323
See application file for complete search history.

(56) References Cited

FOREIGN PATENT DOCUMENTS

| | | |
|---|---|---|
| JP | 56-15866 | 2/1981 |
| JP | 6-246215 | 9/1994 |
| JP | 7-52296 | 6/1995 |
| JP | 11-262715 | 9/1999 |
| JP | 2002-14557 | 1/2002 |
| JP | 2004-122705 | 4/2004 |
| JP | 2004-322026 | 11/2004 |
| JP | 2005-152830 | 6/2005 |
| JP | 2007-245072 | 9/2007 |

*Primary Examiner*—Brenda A Lamb
(74) *Attorney, Agent, or Firm*—Cooper & Dunham, LLP

(57) ABSTRACT

A coating film forming apparatus, which applies a paint to an outer circumferential face of an object to be coated to form a coating film, the coating film forming apparatus, includes: a retention section which retains the coated object in a state in which the outer circumferential face is exposed and in which an axial core of the coated object is in parallel with a vertical direction; an applying nozzle formed in an annular shape, arranged to oppose the outer circumferential face and to have an interval therebetween, and coaxially arranged with the coated object retained by the retention section, the applying nozzle having a first slit, which discharges the paint to an inner circumferential face formed throughout a whole circumference thereof; a movement section, which relatively moves the retention section and the applying nozzle along the axial core; a paint supply section which supplies the paint to the applying nozzle; and a gaseous body discharger which discharges a gaseous body toward the paint discharged in a conic shape from the first slit, evenly throughout a whole circumference in a circumferential direction of the discharged paint, to change a discharging direction of the paint.

12 Claims, 9 Drawing Sheets

COATING FILM FORMING APPARATUS, ELECTROPHOTOGRAPHIC FIXING MEMBER FORMED BY COATING FILM APPARATUS, AND IMAGE FORMING APPARATUS HAVING ELECTROPHOTOGRAPHIC FIXING MEMBER

CROSS REFERENCE TO RELATED APPLICATIONS

The present application is based on and claims priority from Japanese Application Number 2006-356389, filed Dec. 28, 2006, the disclosure of which is hereby incorporated by reference herein in its entirety.

BACKGROUND

The present invention relates to a coating film forming apparatus, which applies a paint to an outer circumferential face of a cylindrical-shaped object to be coated to form a coating film. Particularly, the invention relates to a coating film forming apparatus, which is suitable for forming an elastic layer for fixing members such as a fixing roller and a fixing belt to fix an unfixed toner image on a transfer paper by heating and pressing, for example, in image forming apparatuses, such as a PPC (Plain Paper Copier), an LBP (Laser Beam Printer), a facsimile and so on, in which an electrophotographic system is adopted.

In image forming apparatuses such as a copier, a printer, etc., based on a principle of electrophotography, a transfer paper where a toner image has been transferred, is passed between a heated fixing member and a pressurizing member which press-contacts with the fixing member, to melt toner of the toner image and to fix the toner image on the transfer paper, so as to perform a fixing process. The fixing member, which is used in the fixing process such as a fixing roller, a fixing belt or the like, is obtained by applying a primer (an adhesive), to a cylindrical-shaped core metal, comprising aluminum, iron and so on, or to an endless-shaped base body comprising polyimide, nickel and so on, and then by applying a paint having a heat-resistant rubber such as a silicone rubber and the like on the primer, and thereby an elastic layer having a thickness of about 100-300 μm is formed. (For example, refer to Japanese patent publication No. 2002-14557.)

The elastic layer is generally known to equalize a pressure to press toner on a transfer paper and improve a degree of granularity of an image, in the fixing process described above. Additionally, a thickness of the elastic layer is required to be even, because the thickness of the elastic layer influences a fixed image quality and a start-up time of the fixing member (a time which takes to reach a predetermined temperature).

As a method of forming the elastic layer described above, a dipcoating, a spray coating, a blade coating, a roll coating and so on are known.

The dipcoating method is relatively simple in that an object to be coated such as the cylindrical-shaped core metal, the endless-shaped base body or the like is dipped into a liquid tank filled with a paint, and after that, the coated object is moved up and down, and thereby the paint is applied to the coated object. However, in the dip coating method, there are some problems as follows. For example, when dipping, a difference of a layer thickness between a top part and a bottom part of the coated object occurs. In addition, when a paint with a high viscosity is applied to the coated object as a thin film, production efficiency is low, because a viscosity of the paint determines a speed of up-and-down movement (an applying speed) of the coated object. However, even when the paint with the high viscosity is diluted with a solvent and the like to make the viscosity lower, an unevenness of the thickness of the paint occurs in the liquid tank, and it is very difficult to maintain a liquid property.

The spray coating method described above is an applying method of spraying a paint in the form of a mist. However, there are some problems as follows. For example, when the paint with a high viscosity is used, it is required to be diluted with a solvent and the like. In addition, a smoothness of a coating film is inferior, because of blowing a sprayed paint onto the coated object. Furthermore, an arrival rate of the paint to the coated object is about several percent to 30%, and thus a yield of the paint is extremely low and the production efficiency is low.

The blade coating method and the roll coating method described above are applying methods in which a blade or a roller is arranged in an axial core direction of the coated object, the paint is applied to the coated object while the coated object is rotated, and the blade or the roller is moved back after one rotation of the coated object. However, there are some problems as follows. For example, when the blade or the roller is moved back, a part of a coating film becomes thicker than other parts of the coating film because of the viscosity of the paint, and thereby an even coating film cannot be obtained. Additionally, this partial uneven coating film may be a direct cause of triggering a low quality of a fixed image such as a partial lack of the fixing, a partial unevenness of light and shade and so on, especially in the electrophotographic fixing member.

The applying methods described above are not always suitable for a production of the elastic layer on the fixing member, in which the paint such as a silicone rubber with a high viscosity and the like is required to be evenly applied as a thin film, and are not efficient for mass productivity.

To solve the problems described above, an annular applying method, for example, in which a paint is discharged from an annular nozzle along an outer circumferential face of an object to be coated, and the paint is applied by relatively moving the nozzle and the coated object, has been disclosed (See, for example Japanese patent examined publication No. H07-52296 and Japanese patent publication numbers 2005-152830 and S56-15866).

Japanese patent examined publication No. H07-52296 and Japanese patent publication numbers 2005-152830 and S56-15866 disclose a paint applying method, in which an annular applying nozzle having a slit, which discharges a paint throughout a whole circumference of the coated object, where an axial core thereof is supported parallel to a vertical direction, is provided, and the coated object is relatively moved up in the vertical direction to the annular applying nozzle while discharging the paint, and thereby the annular applying nozzle applies the paint to the outer circumferential face of the coated object. In the applying method using this annular applying nozzle, the paint is not exposed to air just before the paint discharges from the annular applying nozzle, and which makes it easily possible to accurately manage a viscosity, a surface tension, a density and a temperature of this paint, and makes it possible to maintain a smoothness and an evenness of a coating film well. Additionally, it is possible to increase the applying speed by adjusting a supply of the paint, and productivity is significantly better compared to the dipcoating method described above. Furthermore, most of the discharged paint reaches or adheres to the outer circumferential face of the coated object, so that the yield of the paint is high.

However, in applying methods disclosed in Japanese patent examined publication No. H07-52296 and Japanese patent publication numbers 2005-152830 and S56-15866 described above, there is a problem in that the paint does not reach or adhere to the outer circumferential face of the coated object, when an interval between the coated object and the annular applying nozzle becomes larger than a certain interval. Therefore, it is necessary to install plural coating film forming apparatuses, in which a distance between the annular applying nozzle and the outer circumferential face of the coated object is adjusted according to the diameters of each object, when a coating film is to be formed on various types of the coated object having different diameters, and there is a tendency to increase the cost of equipment.

In addition, the coated objects are not only formed in a cylindrical shape having the same diameters all along the axial core direction from one end to the other end, but also are formed in an hourglass shape (inverted-crown shape) having a smaller diameter at the center in the axial core direction than at the end in the axial core direction, and moreover, are formed in a crown shape-having a smaller diameter at the end in the axial core direction than at the center in the axial direction. However, in the applying methods disclosed in Japanese patent examined publication No. H07-52296 and Japanese patent publication numbers 2005-152830 and S56-15866 described above, there are problems in that, for example, the paint does not reach the center of the hourglass-shaped coated object and a thickness becomes thinner at the center of the crown-shaped coated object than at both ends of the crown-shaped object. Therefore, it is difficult to apply the paint to the coated objects, in which diameters vary along the axial core direction.

BRIEF SUMMARY

In an aspect of this disclosure there are provided a coating film forming apparatus, which can easily form an even-thickness coating film and widely correspond to many types of objects to be coated, having different diameters, to provide an electrophotographic fixing member which is formed by the coating film forming apparatus, and an image forming apparatus including the electrophotographic fixing member.

A coating film forming apparatus which applies a paint to an outer circumferential face of an object to be coated to form a coating film, in an exemplary embodiment of this disclosure, includes: a retention section which retains the object to be coated in a state in which the outer circumferential face is exposed and in which an axial core of the object to be coated is in parallel with a vertical direction; an applying nozzle formed in an annular shape, arranged to oppose the outer circumferential face and to have an interval therebetween, and coaxially arranged with the object to be coated retained by the retention section, the applying nozzle having a first slit, which discharges the paint to an inner circumferential face formed throughout a whole circumference thereof; a movement section, which relatively moves the retention section and the applying nozzle along the axial core; a paint supply section which supplies the paint to the applying nozzle; and a gaseous body discharger which discharges a gaseous body toward the paint discharged in a conic shape from the first slit, evenly throughout a whole circumference in a circumferential direction of the discharged paint, to change a discharging direction of the paint.

Preferably, the gaseous body discharger includes: a gaseous body storage room formed in an annular shape throughout a whole circumference of the applying nozzle; and in which the gaseous body is stored; a second slit connected with the gaseous body storage room and opened throughout a whole circumference of the inner circumferential face of the applying nozzle, and which discharges the gaseous body; and a piston arranged movably in the gaseous body storage room, and which moves toward the second slit to discharge the gaseous body stored in the gaseous body storage room from the second slit.

Preferably, the gaseous body discharger includes: a gaseous body storage room formed in an annular shape throughout the whole circumference of the applying nozzle, and in which the gaseous body is stored; a second slit that communicates with the gaseous body storage room and is opened throughout the whole circumference of the inner circumferential face of the applying nozzle, and which discharges the gaseous body; and a pressurized gaseous body supply source which sends pressurized air to the gaseous body storage room.

Preferably, the gaseous body discharger further includes a shutter member formed in an annular shape along the inner circumferential face of the applying nozzle, and which moves along the axial direction to change an opening area of the second slit.

Preferably, a coating film forming apparatus further includes a control section configured to: discharge the paint from the first slit of the applying nozzle which is in a state of opposing a one end part of the object to be coated retained by the retention section; control the movement section and the paint supply section such that the applying nozzle is relatively moved toward another end part of the object to be coated while the paint is discharged from the first slit; and control a gaseous body flow quantity discharged by the gaseous body discharger according to a change of an interval between the outer circumferential face of the object to be coated and the inner circumferential face of the applying nozzle.

In addition, there is provided, in another exemplary embodiment, an electrophotographic fixing member which is formed by the coating film forming apparatus, according to any one of the coating film forming apparatuses described above.

Moreover, there is provided an image forming apparatus having the electrophotographic fixing member described above.

DETAILED DESCRIPTION OF THE PREFERRED EMBODIMENTS

Embodiment 1

Figure 1:
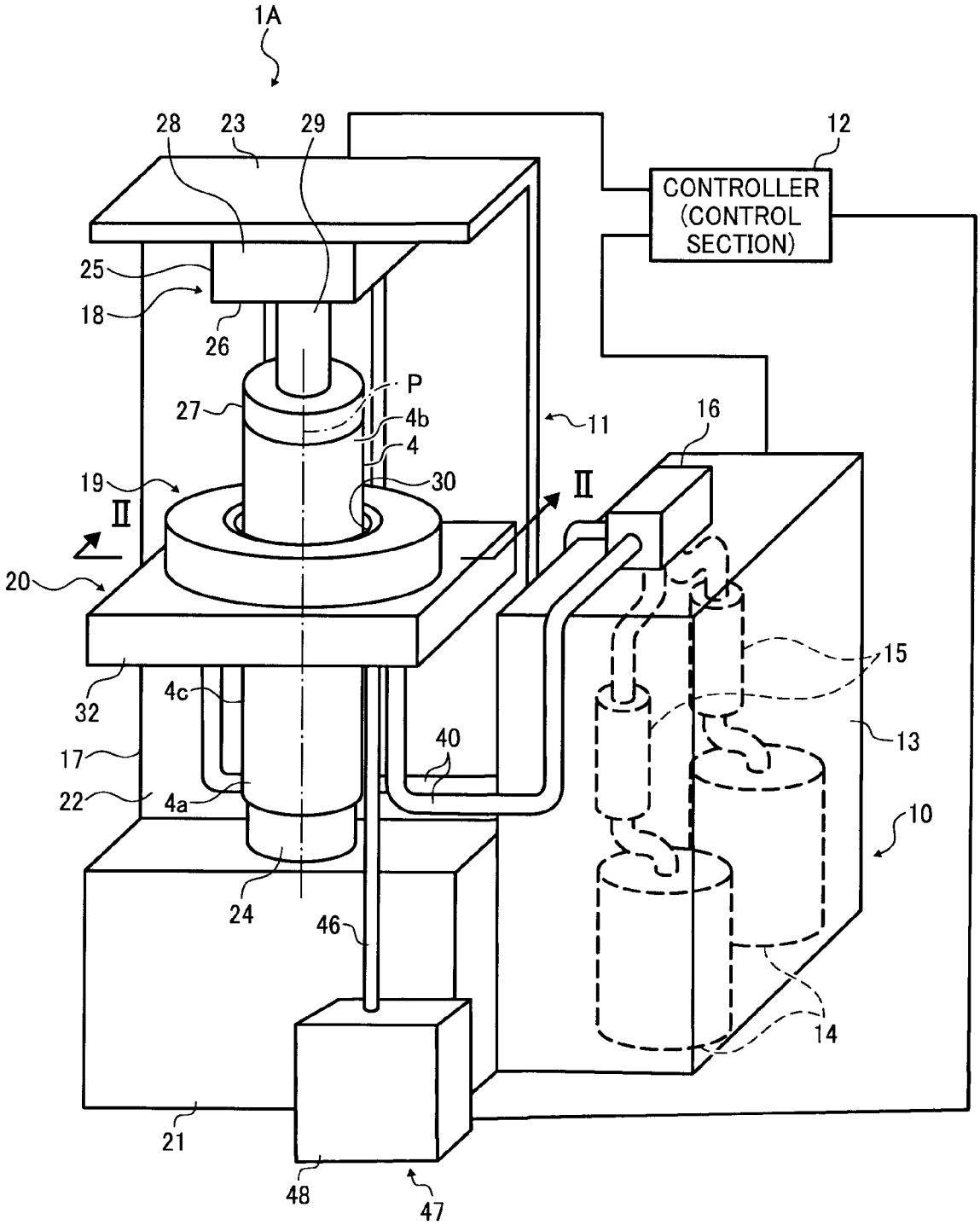
FIG. 1 is a perspective view of a schematic structure of a coating film forming apparatus according to an embodiment 1 of the present invention.
Figure 2:
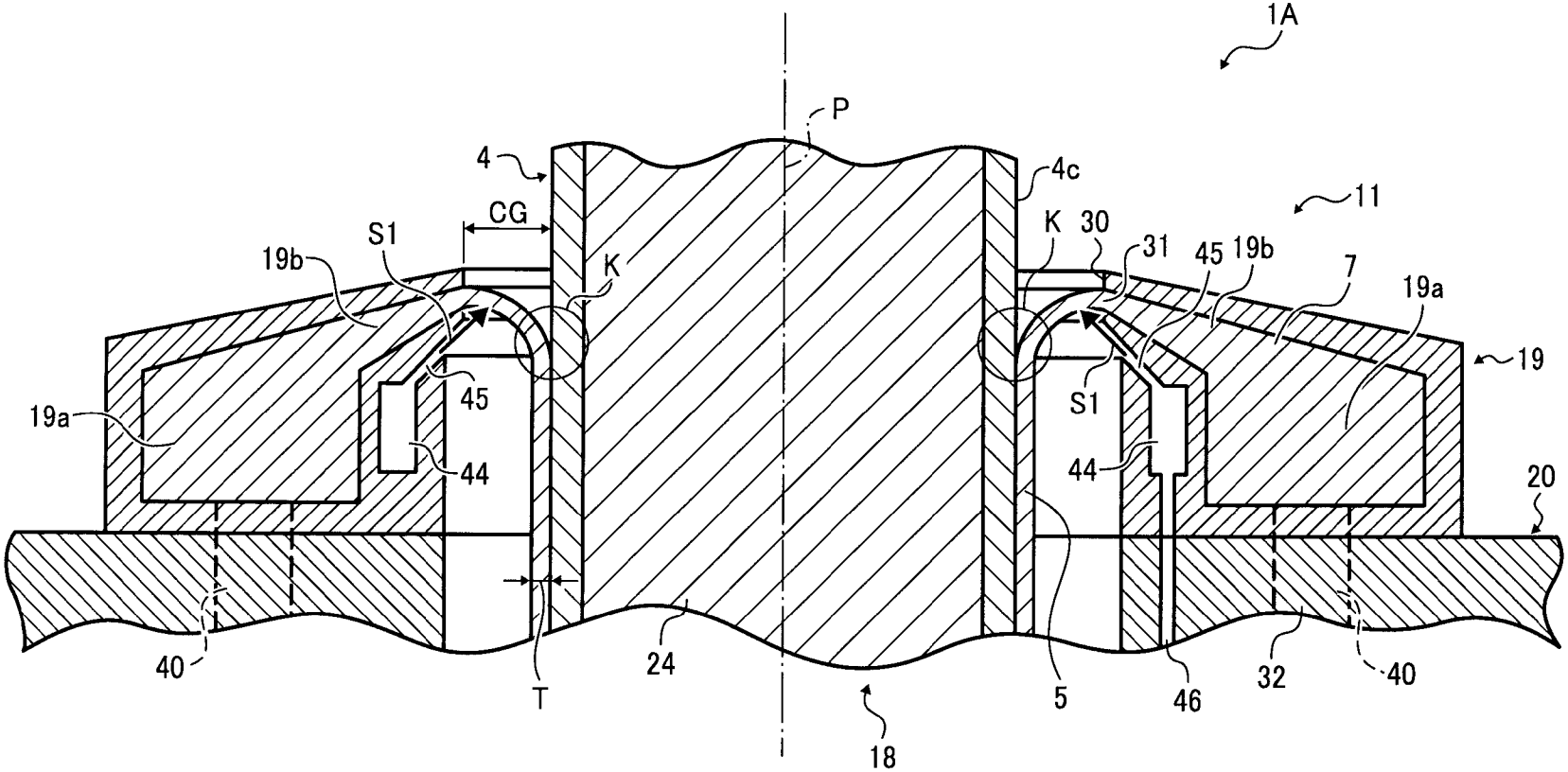
FIG. 2 is a cross-sectional view of FIG. 1 taken along a line II-II.
Figure 6:
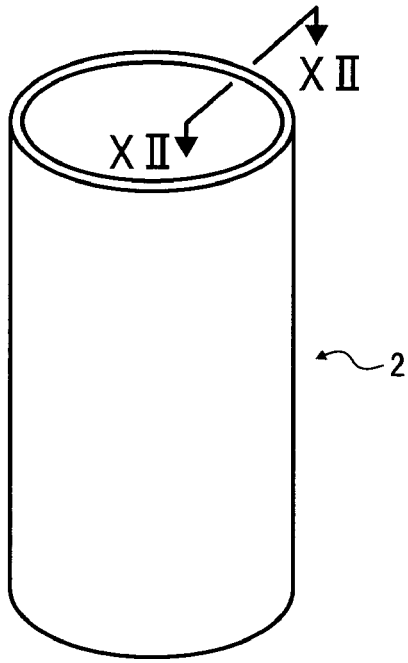
FIG. 6 is a perspective view of a fixing roller obtained by forming a coating film by the coating film forming apparatus illustrated in FIG. 1.
Figure 7:
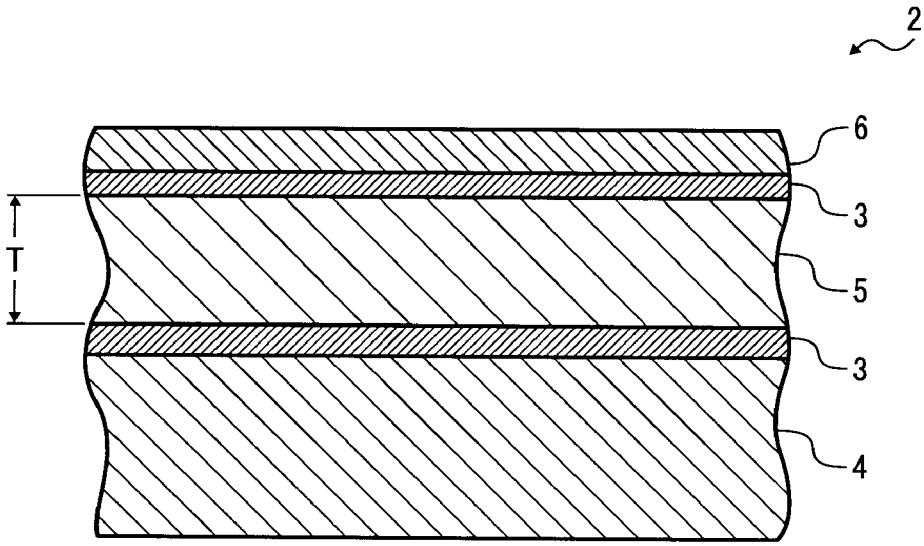
FIG. 7 is a cross-sectional view of FIG. 6 taken along a line XII-XII.

FIG. 1 is a perspective view illustrating a schematic structure of a coating film forming apparatus according to an embodiment 1 of the present invention. FIG. 2 is a cross-sectional view of FIG. 1 taken along a line II-II. FIG. 6 is a perspective view of a fixing roller obtained by forming a coating film by the coating film forming apparatus illustrated in FIG. 1. FIG. 7 is a cross-sectional view of FIG. 6 taken along a line XII-XII.

A coating film forming apparatus 1A illustrated in FIG. 1, is an apparatus that forms an elastic layer as a coating film by applying a paint 7 to a base body 4. The base body 4 is a fixing roller 2 (illustrated in FIG. 6) as an object to be coated, which is an electrophotographic fixing member for structuring an image forming apparatus such as a copier. In addition, a two-liquid high temperature hardening type liquid silicone rubber having a viscosity of 30 Pa·s, which includes a silicone rubber and a well-known solvent and so on, is used as the paint 7.

The fixing roller 2 described above, is formed in a cylindrical shape, as illustrated in FIG. 6. Additionally, as illustrated in FIG. 7, this fixing roller 2 is comprised of the base body 4, a primer (adhesive) layer 3, an elastic layer 5, a primer layer 3 and a mold release layer 6, and each layer is stacked in order. The base body 4 is comprised of polyimide, nickel and so on. The base body 4 is formed in a cylindrical shape, which has a 90 μm coating film and a 60 mm diameter. A thickness of the elastic layer 5 is formed about 100-300 μm. The mold release layer 6 is comprised of a fluoride resin. In addition, this elastic layer 5 is formed from one end 4*a* in an axial core direction of the base body 4 as illustrated in FIG. 1 (a bottom part when a paint 7 described later is applied by the coating film forming apparatus 1A) to the other end 4*b* in the axial core direction of the base body 4 (a top part when the paint 7 is applied by the coating film forming apparatus 1A). This fixing roller 2, which is in a heated condition, presses carried toner on a transfer paper to the transfer paper and fixes this toner on the transfer paper.

As illustrated in FIG. 1, the coating film forming apparatus 1A has a paint supply unit 1 as a paint supply section, an applying unit 11, a gas supply unit 47 and a controller 12 as a control section. This paint supply unit 10 has a unit body 13, plural undiluted solution tanks 14, plural pumping-up pumps 15 and a mixer 16. The unit body 13 is placed on a factory floor and so on. The mixer 16 and an applying nozzle 19 described later of the applying unit 11 are connected to each other by two plumbings 40.

The unit body 13 is formed in a box shape and stores the undiluted solution tanks 14 and the pumping-up pump 15 inside. The undiluted solution tanks 14 store liquids as raw materials of the paint 7. In an illustrated example, two undiluted solution tanks 14 are provided. The pumping-up pumps 15 pump up liquids in the undiluted solution tanks 14 and supply to the mixer 16. One pumping-up pump 15 is provided for one undiluted solution tank 14. The mixer 16 is placed on a top surface of the unit body 13. The liquids described above from the plural undiluted solution tanks 14 via the pumping-up pumps 15, are supplied to the mixer 16. The mixer 16 mixes the liquids from the plural undiluted solution tanks 14, produces the paint 7 and sends the paint 7 into the applying nozzle 19 via the plumbings 40.

The applying unit 11 has a frame 17, a retention section 18, the applying nozzle 19 and a movement section 20. The frame 17 has a stand section 21, an extending plate section 22 and an upper plate 23. The stand section 21 is placed on a factory floor and so on. The extending plate section 22 having a plated shape extends upward from the stand section 21. The upper plate 23 having a plated shape extends along a horizontal direction from a top part of this extending plate section 22. This upper plate 23 is formed in a flat plate shape, and faces the stand section 21 at an interval along a vertical direction.

The retention section 18 has a standing pole 24 and an upper chuck 25. The standing pole 24 is formed in a column shape, and stands upward, to a direction in which an axial core is in parallel with a vertical direction, from a top surface of the stand section 21. The standing pole 24 is passed through inside the base body 4 and retains the base body 4. In addition, when the standing pole 24 retains the base body 4, an outer circumferential face of the standing pole 24 and an inner circumferential face of the base body 4 are closely contacted with each other, and an axial core P (illustrated as a dashed-dotted line in FIG. 1) of the base body 4 is in parallel with the vertical direction. Thus, the standing pole 24, that is, the retention section 18, retains the base body 4 such that the axial core P is in parallel with the vertical direction.

The upper chuck 25 has a chuck cylinder 26 and a pressing member 27. The chuck cylinder 26 has a cylinder body 28 and a rod 29. The rod 29 freely protrudes and sinks from the cylinder body 28. The cylinder body 28 is installed in the upper plate 23 described above in a condition such that the rod 29 expands downward along a vertical direction. In addition, the pressing member 27 is formed in a thick disk shape, installed in an end of the rod 29 and coaxially arranged with the standing pole 24. When the rod 29 of the chuck cylinder 26 expands, the pressing member 27 abuts on the top part 4*b* of the base body 4 retained by the standing pole 24, and the upper chuck 25 decides a position of the base body 4 relative to the standing pole 24. When the rod 29 of the chuck cylinder 26 shortens, the pressing member 27 is detached from the top part 4*b* of the base body 4, and the base body 4 is made freely detachable from the standing pole 24 by the upper chuck 25.

The applying nozzle 19, as described in FIG. 2, is formed in an annular shape, and has an annular cavity 19*a* (hereinafter, simply called a paint storage room 19*a*) and an annular cavity 44 (hereinafter, simply called a gas storage room 44). The paint storage room 19*a* is arranged outside in a circumferential direction of the applying nozzle 19 relative to the gas storage room 44. In addition, the paint 7 is supplied to the paint storage room 19*a* from the paint supply unit 10 described above, and gas is supplied to the gas storage room 44 from a gas supply unit 47 described later. The applying nozzle 19 is coaxially arranged with the standing pole 24 and the base body 4 retained by the standing pole 24, and supported movably along the axial core P described above, by the movement section 20. An inner diameter of the applying nozzle 19 is larger than an outer diameter of the base body 4 retained by the standing pole 24. That is, an inner circumferential face 30 of the applying nozzle 19 faces an outer circumferential face 4*c* of the base body 4 at an interval CG and the applying nozzle 19 is coaxially arranged with the base body 4 retained by the retention section 18.

In addition, in the inner circumferential face 30 of the applying nozzle 19, a slit 19*b* that communicates with the outside of the applying nozzle 19 from the paint storage room 19*a* is formed throughout a whole circumference of the applying nozzle 19. The applying nozzle 19 discharges the paint 7 supplied from the paint supply unit 10 to the paint storage room 19*a*, to the outer circumferential face 4*c* of the base body 4 retained by the standing pole 24 and so on of the retention section 18, through the slit 19*b*. In this case, the paint 7 is discharged in a conic curtain shape (plane shape). The paint 7 discharged in a conic curtain shape is described as a "curtain film", which is in a state of being discharged from this slit 19*b* until adhering to the outer circumferential face 4*c* of the base body 4.

In addition, in the inner circumferential face 30 of the applying nozzle 19, a second slit 45 that communicates with the outside of the applying nozzle 19 from the gas storage room 44 is formed throughout a whole circumference of the applying nozzle 19. The applying nozzle 19 discharges the gas supplied from the gas supply unit 47 described later to the gas storage room 44, to the paint 7 discharged in the conic curtain shape from the slit 19*b*, that is, the curtain film, through the second slit 45. (A discharging direction of the gas is described as an arrow S1 in FIG. 2.) In this case, the applying nozzle 19 evenly discharges the gas throughout a whole circumference in a circumferential direction of the curtain film. Additionally, the applying nozzle 19 discharges the gas to a position in which is closer to the slit 19*b* (upstream) than an edge of the curtain film, that is, a contact position K with the outer circumferential face 4*c* (illustrated in FIG. 2).

In the present embodiment, the gas is discharged to the paint 7, which is discharged to the outer circumferential face 4*c* of the base body 4, that is, the curtain film, obliquely from a lower part to an upper part in a vertical direction and from an external side to an internal side in the circumferential direction of the applying nozzle 19. Thus, a discharging direction of the paint 7 from the applying nozzle 19 is changed, and the paint 7 can make contact with a position in the outer circumferential face 4*c* of the base body 4, which is a more internal side in the circumferential direction of the applying nozzle 19 than a position in the outer circumferential face 4*c* of the base body 4, where the paint 7 falls by its own weight. Therefore, a single coating film forming apparatus 1A can widely correspond to many kinds of base bodies 4 having different diameters.

In the present embodiment, although it is not illustrated in a drawing, the gas is discharged to the paint, which is discharged to the outer circumferential face 4*c* of the base body 4, that is, the curtain film, obliquely from an upper part to a lower part in a vertical direction and from an internal side to an external side in the circumferential direction of the applying nozzle 19. Thus, a discharging direction of the paint 7 from the applying nozzle 19 is changed, and the paint 7 can make contact with a position in the outer circumferential face 4*c* of the base body 4, which is a more external side of the circumferential direction of the applying nozzle 19 than a position in the outer circumferential face 4*c* of the base body 4, where the paint 7 falls by its own weight. Therefore, a single coating film forming apparatus 1A can widely correspond to many kinds of base bodies 4 having different diameters.

In the present embodiment, the second slit 45 is formed throughout a whole circumference of the applying nozzle 19, so that the gas 18 evenly discharged throughout a whole circumference of a circumferential direction of the curtain film, which is discharged from the slit 19*b*. This makes it possible to easily form a coating film, that is, an elastic layer, having an even thickness throughout a whole circumference of the base body 4.

The moving section 20 has an applying nozzle supporting plate 32, a linear guide, a motor, a linear encoder and so on. The applying nozzle supporting plate 32 is formed in an annular shape and the applying nozzle 19 is installed on a surface of the applying nozzle supporting plate 32. The standing pole 24 penetrates the applying nozzle supporting plate 32, and the applying nozzle supporting plate 32 is placed between the stand section 21 and the upper plate 23. The linear guide movably supports the applying nozzle supporting plate 32 along a vertical direction. The motor moves the applying nozzle supporting plate 32 along the vertical direction. That is, the motor moves the applying nozzle supporting plate 32 up and down along the vertical direction. The linear encoder detects a position of the applying nozzle supporting plate 32. The linear encoder outputs the detected position of the applying nozzle supporting plate 32 to a controller 12.

Thus, the movement section 20 moves the applying nozzle supporting plate 32 up and down, so that the movement section 20 relatively moves the base body 4 retained by the standing pole 24 and the applying nozzle 20, along the axial core P of the base body 4.

The gas supply unit 47 has a pressurized gas supply source 48 and a plumbing 46. The pressurized gas supply source 48 is placed on a factory floor and so on. The plumbing 46 is mutually connected with the pressurized gas supply source 48 and the gas storage room 44 described above. The pressurized gas supply source 48 is comprised of a storage section and an opening and closing mechanism. The storage section stores gas which is in a pressurized condition. The opening and closing mechanism can open and close a gas path from the storage section to the plumbing 46. An opening and closing movement or the opening and closing mechanism is controlled by a command from the controller 12 described later. That is, the opening and closing mechanism supplies the gas stored in the storage section to the gas storage room 44 via the plumbing 46, stops supplying and adjusts a gas flow quantity from the storage section to the gas storage room 44, by the command from the controller 12. A gas discharger is comprised of the gas storage room 44, the second slit 45 and the gas supply unit 47.

The controller 12 described above is a computer having a well-known RAM, ROM, CPU and so on. The controller 12 is connected with the paint supply unit 10, the applying unit 11 and the gas supply unit 47, controls these units and entirely controls the coating film forming apparatus 1A. Size data of the base body 4 is memorized in the controller 12 beforehand. The gas flow quantity according to the interval CG between the applying nozzle 19 and the outer circumferential face 4*c* of the bane body 4 is supplied from the gas supply unit 47, so that a contact position K, where the curtain film discharged from the slit 19*b* and the outer circumferential face 4*c* of the base body 4 make contact with, can be a predetermined height relative to a discharging hole 31 of the slit 19*b*.

In the present embodiment, for example, a coating film having an even thickness from the one end part 4*a* to the other end part 4*b*, is formed on the base body 4 having a same diameter from the one end part 4*a* to the other end part 4*b* along the axial core P direction. Therefore, a gas supply quantity from the gas supply unit 47 described above is controlled by the controller 12 to be stable all the time from a beginning to an ending of applying the paint 7.

In addition, information on a position of the applying nuzzle supporting plate 32, in other words, information on a position of the applying nozzle 19, is inputted to the controller 12 from the liner encoder of the movement section 20. Based on the information on the position of the applying nozzle supporting plate 32, as explained as follows, the controller 12 controls movements of the chuck cylinder 26, the motor of the movement section 20, the mixer 16 of the paint supply unit 10, the gas supply unit 47 and so on, applies the paint 7 to the outer circumferential face 4*c* of the base body 4 and forms the coating film, that is, the elastic layer 5.

In other words, when the coating film forming apparatus 1A forms the coating film, that is, the elastic layer 5 on the outer circumferential face 4*c* of the base body 4, first of all, the controller 12, stops the paint supply unit 10, shortens the rod 26 of the chuck cylinder 26, moves the applying nozzle supporting plate 32 and places the applying nozzle 19 in an uppermost part of the frame 17. And after installing the base body 4 in the standing pole 24, the controller 12 extends the rod 29 of the chuck cylinder 26 and determines a position of the base body 4 by the pressing member 27. Subsequently, the controller 12 moves the applying nozzle 32 down to a lowermost part of the frame 17, and the discharging hole 31 of the slit 16*b* of the applying nozzle 19 is placed in an applying beginning position facing the bottom part 4*a* of the base body 4.

The controller 12 controls the paint supply unit 10 to supply the paint 7 to the applying nozzle 19 and to discharge the paint 7 from the slit 19*b* of the applying nozzle 19 to the outer circumferential face 4*c* of the base body 4, that is, the bottom part 4*a* of the base body 4. And the controller 12 also controls the gas supply unit 47 to supply the predetermined gas flow quantity, according to the interval CG between the applying nozzle 19 and the base body 4, to the applying nozzle 19, and to discharge the gas from the second slit 45 of the nozzle 19 to the paint 7, that is, the curtain film.

"t" seconds after beginning of discharging the paint 7, and after adhering the paint 7 discharged from the slit 19*b* to the bottom part 4*a* of the base body 4, the controller 12 raises the applying nozzle 19 to the movement section 20, relative to the base body 4 (movement toward the top part 4*b*). The time of "t" seconds is a time from beginning of discharging the paint 7 to adhering the paint 7 to the bottom part 4*a* of the base body 4. In the present embodiment, "t" is set to a range of $1000 \leqq t \leqq 3000$ (msec). By setting the range as described above, after the edge of the curtain film discharged from the applying nozzle 19 makes contact with the outer circumferential face 4*c* of the base body 4, a rise of the applying nozzle 19 begins without forming a bead and without breaking the curtain film, and the elastic layer having an even thickness can be formed. Thus, the controller 12 raises the applying nozzle 19 while discharging the paint 7 from the slit 19*b*.

When the discharging hole 31 of the slit 19*b* of the applying nozzle 19 is placed in an applying ending position facing the top part 4*b* of the base body 4, the controller 12 controls the paint supply unit 10 to stop supplying the paint 7, controls the gas supply unit 47 to stop supplying the gas and controls the movement section 20 to stop and to stop the rise of the applying nozzle 19 relative to the base body 4 (movement toward the top part 4*b*). Thus, the paint 7 is applied on the outer circumferential face 4*c* of the base body 4 from the bottom part 4*a* to the top part 4*b*. Solvents in the paint 7 evaporate and so on, and the elastic layer 5 as a coating film is formed on the outer circumferential face 4*c* of the base body 4.

After that, the controller 12 shortens the rod 29 of the chuck cylinder 26 and releases the pressing member 27 from the base body 4. The base body 4 on which the elastic layer 5 was formed is removed from the standing pole 24. A base body 4 on which an elastic layer 5 is not yet formed is attached to the standing pole 24, and the elastic layer 5 is formed, as a process described above as well.

Thus, the controller 12 of the coating film forming apparatus 1A described above begins discharging the paint 7 from the slit 19*b* of the applying nozzle 19 in a state of facing flue bottom part 4*a* of the base body 4 retained by the standing pole 24. Subsequently, the controller 12 controls the movement section 20 and the paint supply unit 10 to move the applying nozzle 19 to the top part 4*b* of the base body 4 while discharging the paint 7 from the slit 19*b*. The controller 12 is synchronized with the movements described above, and controls the gas supply unit 47 to discharge the predetermined flow quantity of the gas, according to the interval CG between the outer circumferential face 4*c* of the base body 4 and the inner circumferential face 30 of the applying nozzle 19, from the second slit 45 of the applying nozzle 19.

According to the present embodiment, it is possible to easily form the elastic layer 5 having the even thickness, relative to both in the circumferential direction of the base body 4 and in the axial core P direction. In addition, it is possible to widely correspond to many kinds of base bodies having different diameters. Because the elastic layer 5 is formed from the lower part to the upper part in the vertical direction of the base body 4 in order. And air which tries to invade a gap between the paint 7 and the base body 4 runs through the upper part of the base body 4. And thereby, it is possible to prevent the air from invading the gap between the paint 7 and the base body 4. Therefore, it is possible to prevent bubbles from occurring in the elastic layer 5 as the coating film, and to obtain the elastic layer 5 as a high-quality coating film.

Embodiment 2

Figure 3:
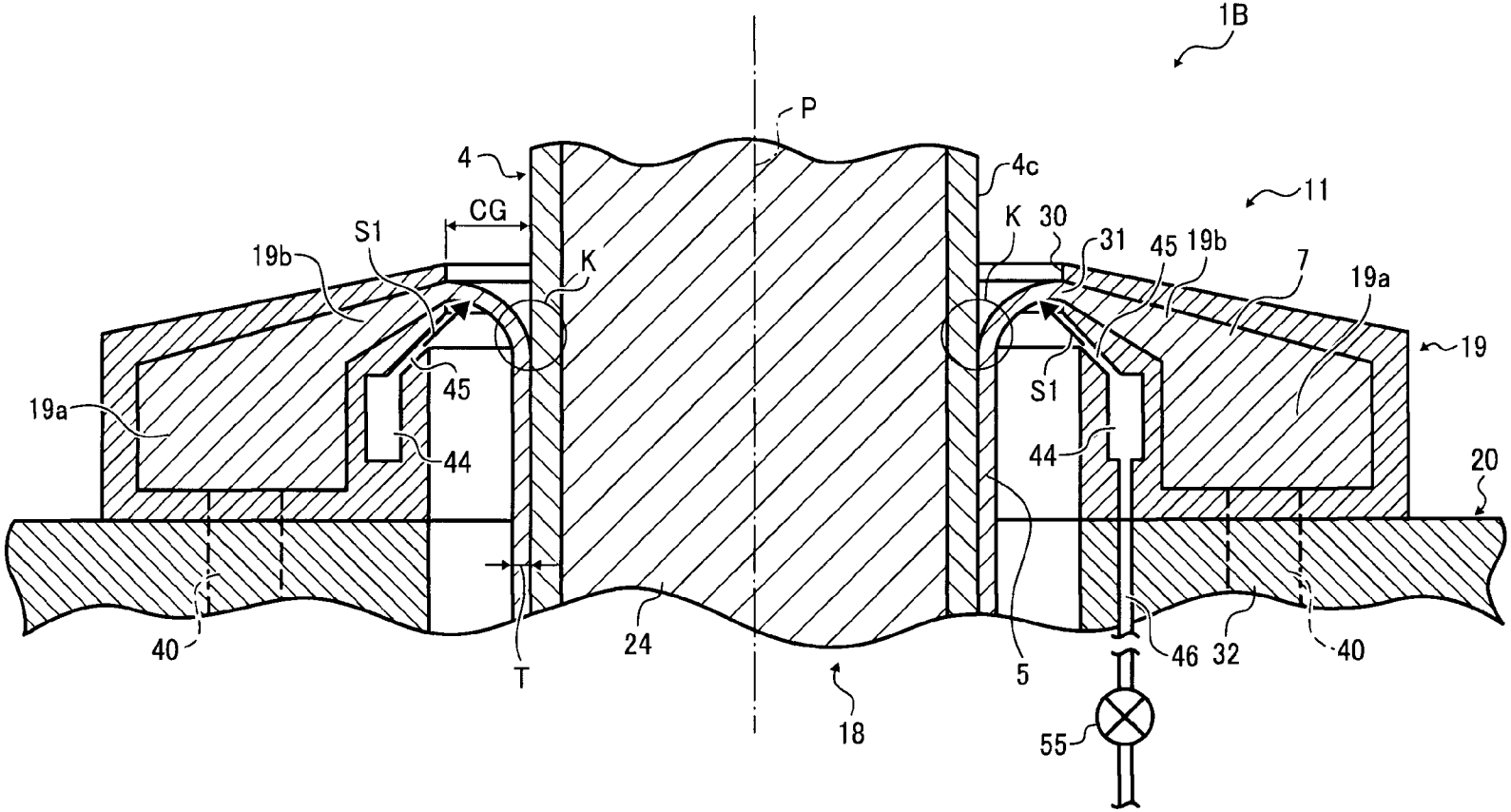
FIG. 3 is a cross-sectional view of a main part of a coating film forming apparatus according to an embodiment 2 of the present invention.

FIG. 3 is a cross-sectional view of a main part of a coating film forming apparatus according to an embodiment 2 of the present invention. In this drawing, the same components already described in the embodiment 1 are given the same reference numerals, and the explanations thereof are not described in detail.

A coating film forming apparatus 1B according to the present embodiment has the structure of the coating film forming apparatus 1A, which is explained in the embodiment 1, and in addition a bulb 55 which is installed in the plumbing 46, as illustrated in FIG. 3. The bulb 55 is controlled by the controller 12 to change a gas flow quantity, which passes through the bulb 55, according to a change of the interval CG between the outer circumferential face 4*c* of the base body 4 and the inner circumferential face 30 of the applying nozzle 19. The controller 12 memorizes data associated with a size of the base body 4, a movement speed of the applying nozzle supporting plate 32 and a movement time of the applying nozzle supporting plate 32. That is, the controller 12 memorizes the interval CG between the inner circumferential face 30 of the applying nozzle 19 and the outer circumferential face 4*c* of the base body 4, which is x seconds after when the applying nozzle supporting plate 32 moves from the lower part to the upper part of the frame 17.

For example, when the elastic layer 5 is formed by the coating film forming apparatus 1B on a base body (not illustrated) having an hourglass shape (an inverted-crown shape), in which a center part in an axial core direction has a smaller diameter than an end part in the axial core direction, the controller 12 controls the gas flow quantity from the second nozzle 45, that is, the gas flow quantity passing through the bulb 55, such that the gas flow quantity passing through the bulb 55 is gradually bigger as the applying nozzle 19 moves from the applying beginning position facing a bottom part of this base body to a position facing the center part of this base body, it is the biggest as the applying nozzle 19 at a position facing the center part formed in the smallest diameter, and it is gradually smaller as the applying nozzle 19 moves from a position facing this center part to the applying ending position facing a top part of the base body.

In the present embodiment, thus, when the coating film, that is, the elastic layer 5, is formed on the base body, in which the diameter varies along the axial core direction, the controller 12 changes an opening and closing amount of the bulb 55 according to the change of the interval CG between the outer circumferential face of the base body and the inner circumferential face 30 of the applying nozzle 19, and changes the gas flow quantity discharged from the second slit 45. As a result, a discharging direction of the paint 7 changes such that the edge part of the curtain film discharged from the slit 19*b* always hits the outer circumferential face of the base body. And thereby, it is also possible to form a coating film having an even thickness, that is, an elastic layer 5, on a base body such as having an hourglass shape (an inverted-crown shape), in which a diameter varies along the axial core direction.

Embodiment 3

Figure 4:
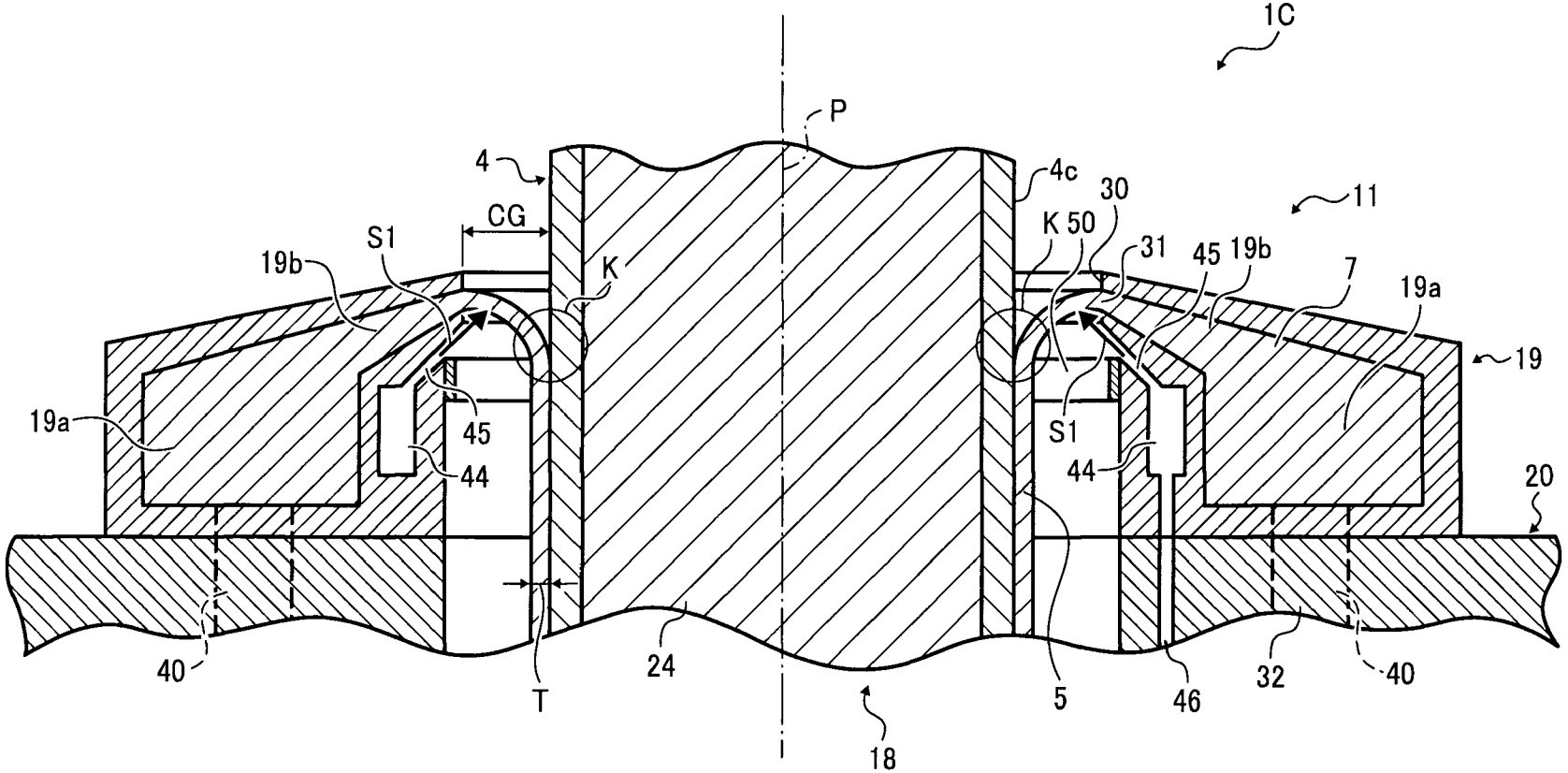
FIG. 4 is a cross-sectional view of a main part of a coating film forming apparatus according to an embodiment 3 of the present invention.

FIG. 4 is a cross-sectional view of a main part of a coating film forming apparatus according to an embodiment 3 of the present invention. In this drawing, the same components already described in the embodiments 1 and 2 are given the same reference numerals, and the explanations thereof are not described in detail.

A coating film forming apparatus 1C according to the present embodiment, has the structure of the coating film forming apparatus 1A, which is explained in the embodiment 1, and in addition, a shutter member 50 which changes an opening area of the second slit 45, as illustrated in FIG. 4. This shutter member 50 is formed in an annular shape along the inner circumferential face 30 of the applying nozzle 19, and is movably supported along an axial core direction of the applying nozzle 19 by a movement mechanism which is not illustrated. The shutter member 50 moves according to a change of the interval CG between the outer circumferential face 4*c* or the base body 40 and the inner circumferential face 30 of the applying nozzle 19 and changes the opening area of die second slit 45. Thus, the movement of the shutter member 50 is controlled by the controller 12. A gas flow quantity discharged from the second slit 45 is changed by changing the opening area of the second slit 45. In this embodiment, the gas discharger is comprised of the gas storage room 44, the second slit 45, the gas supply unit 47 and the shutter member 50. The controller 12 memorizes data associated with a size of the base body 4, a movement speed of the applying nozzle supporting plate 32 and a movement time of the applying nozzle supporting plate 32. That is, the controller 12 memorizes the interval CG between the inner circumferential face 30 of the applying nozzle 19 and the outer circumferential face 4*c* of the base body 4, which is x seconds after when the applying nozzle supporting plate 32 moves from the lower part 17 to the upper part of the frame.

For example, when the elastic layer 5 is formed by the coating film forming apparatus 1C on a base body (not illustrated) having a crown shape, in which a center part in an axial core direction has a larger diameter than an end part in the axial core direction, the controller 12 controls the gas flow quantity from the second nozzle 45, such that the gas flow quantity from the second nozzle 45 is gradually smaller as the applying nozzle 19 goes from an applying beginning position facing the bottom part of the base body to a position facing the center part of the base body and the shutter member 50 moves to make the opening area of the second slit 45 smaller, it is the smallest as the applying nozzle 19 in a position facing the center part which is formed in the largest diameter, and it is gradually bigger as the applying nozzle 19 goes from a position facing the center part of the base body to an applying ending position facing the top part of the base body and the shutter member 50 moves to make the opening area of the second slit 45 larger.

In the present embodiment, thus, when the coating film, that is, the elastic layer 5 is formed on the base body, in which the diameter varies along the axial core direction, the controller 12 moves the shutter member 50 according to the change of the interval CG between the outer circumferential face of the base body and the inner circumferential face 30 of the applying nozzle 19, changes the opening area of the second slit 45, and changes the gas flow quantity discharged from the second slit 45. As a result, a discharging direction of the paint 7 changes such that the edge part of the curtain film discharged from the slit 19*b* always hits the outer circumferential face of the base body. And thereby, it is also possible to form a coating film having an even thickness, that is, an elastic layer 5, on a base body such as having a crown shape, in which a diameter varies along the axial core direction.

Embodiment 4

Figure 5:
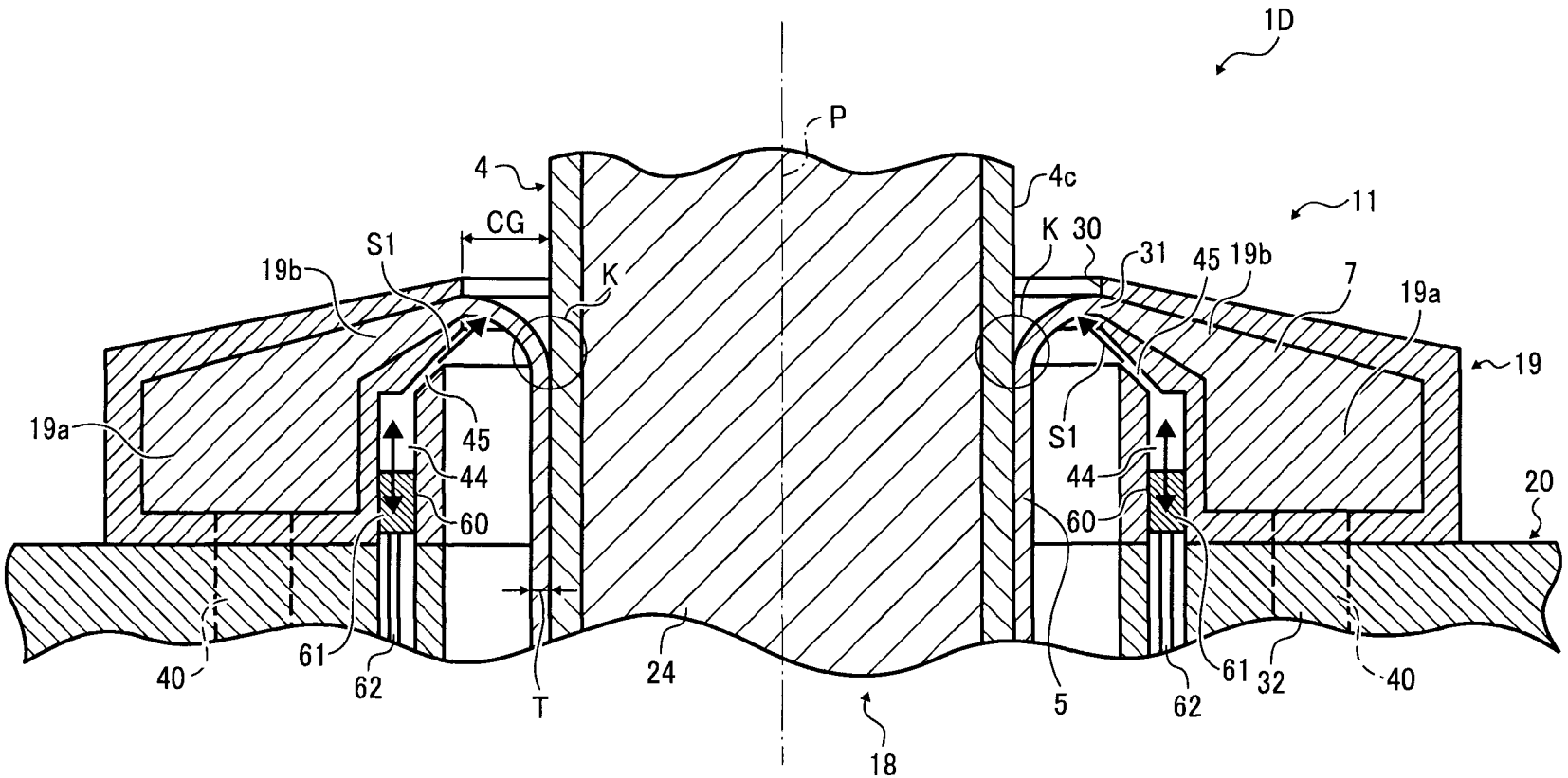
FIG. 5 is a cross-sectional view of a main part of a coating film forming apparatus according to an embodiment 4 of the present invention.

FIG. 5 is a cross-sectional view of a main part of a coating film forming apparatus according to an embodiment 4 of the present invention. In this drawing, the same components already described in the embodiments 1, 2 and 3 are given the same reference numerals, and the explanations thereof are not described in detail.

A coating film forming apparatus 1D according to the present embodiment, as illustrated in FIG. 5, has a structure of the coating film forming apparatus 1A as explained in the embodiment 1 having a piston 60 instead of the gas supply unit 47. The piston 60 has a movement member 61 and a rod 62. The movement member 61 is formed to move along an interior surface of the gas storage room 44. The rod 62 is mutually connected with this movement member 61 and a movement mechanism which is not illustrated. This movement member 61 is movably supported in the gas storage room 44 by the movement mechanism.

In addition, the movement member 61 moves from a position which is away from the second slit 45 to a direction which is closer to the second slit 45, and thereby air (gas) in the gas storage room 44 is discharged from the second slit 45. The piston 60 moves while changing a movement speed of the piston according to a change of the interval CG between the outer circumferential face 4*c* of the base body 4 and the inner circumferential face 30 of the applying nozzle 19, such that an air flow quantity discharged from the second slit 45 is changed. And thereby the movement speed and a movement amount of the piston is controlled by the controller 12. Additionally, in the present embodiment, the gas discharger is comprised of the gas storage room 44, the second slit 45 and the piston 60. The controller 12 memorizes data associated with a size of the base body 4, the movement speed of the applying nozzle supporting plate 32, and a movement time of the applying nozzle supporting plate 32. That is, the controller 12 memorizes the interval CG between the inner circumferential face 30 of the applying nozzle 19 and the outer circumferential face 4*c* of the base body 4, which is x seconds after when the applying nozzle supporting plate 32 moves from the lower part to the upper part of the frame 17.

In the present embodiment, thus, the controller 12 changes the movement speed of the piston 60 according to a change of the interval CG between the outer circumferential face of the base body, on which the elastic layer 5 is formed by the present apparatus 1D, and the inner circumferential face 30 of the applying nozzle 19, and thereby the air flow quantity discharged from the second slit 45 is changed. As a result, a discharging direction of the paint 7 changes such that the edge part of the curtain film discharged from the slit 19*b* always hits the outer circumferential face of the base body. For example, it is possible to form a coating film having an even thickness, that is, an elastic layer 5, on a base body, in which a diameter varies along the axial core direction.

In addition, as described in the present embodiment, the gas may be gas and also may be air. In other words, any gas, which is possible to discharge to the curtain film, can be used.

A coating film forming apparatus (not illustrated) according to a comparative example 1 has a structure of the coating film forming apparatus 1A explained in the embodiment 1 having an applying nozzle 19' (See FIG. 8) instead of the applying nozzle 19. The applying nozzle 19' has a same structure as the applying nozzle 19 except without having the gas storage room 44 and the second slit 45.

Comparative Example 2

Figure 8:
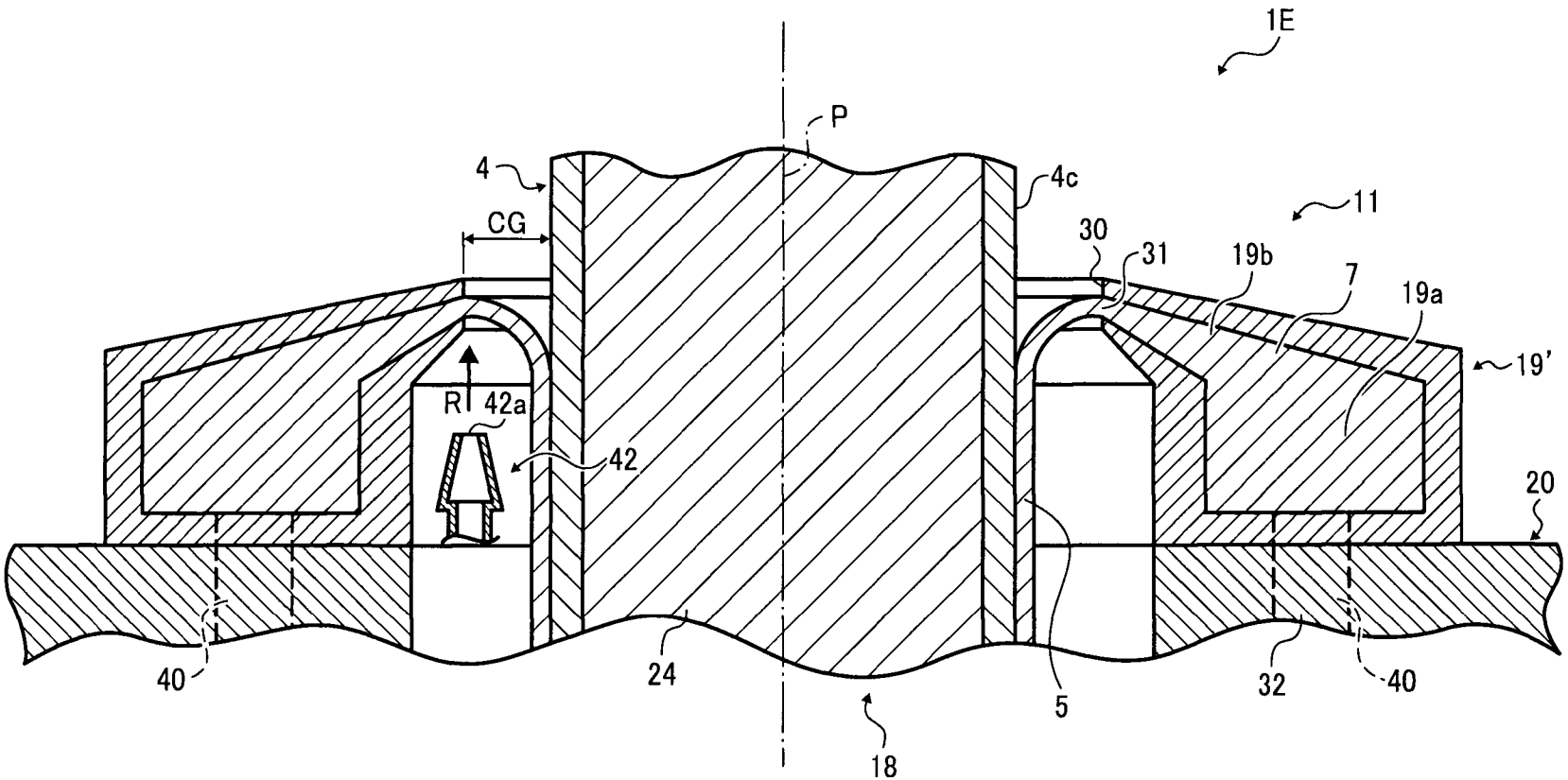
FIG. 8 is a cross-sectional view of a main part of a coating film forming apparatus according to a comparative example 2 of the present invention.

FIG. 8 is a cross-sectional view of a main part of a coating film forming apparatus according to a comparative example 2 of the present invention. In this drawing, the same components already described in the embodiments 1, 2, 3 and 4 are given the same reference numerals, and the explanations thereof are not described in detail.

A coating film forming apparatus 1E according to the comparative example 2, as illustrated in FIG. 8, has a structure of the coating film forming apparatus 1A explained in the embodiment 1 having an applying nozzle 19' instead of the applying nozzle 19, and additionally has a gas discharging nozzle 42. The applying nozzle 19' has a same structure as the applying nozzle 19 described above except without having the gas storage room 44 and the second slit 45 described above.

In addition, the gas discharging nozzle 42, is connected with the gas supply unit, which is not illustrated, and discharges the gas supplied from this gas supply unit to the paint 7 discharged from the slit 19*b*, that is, the curtain film. (a discharging direction of the gas is illustrated as an arrow R in FIG. 8.) A numeral 42*a* denotes a gas discharging nozzle hole. An only single gas discharging nozzle 42 is provided between the inner circumferential face 30 of the applying nozzle 19' and the outer circumferential face 4*c* of the base body 4.

Comparative Example 3

Figure 9:
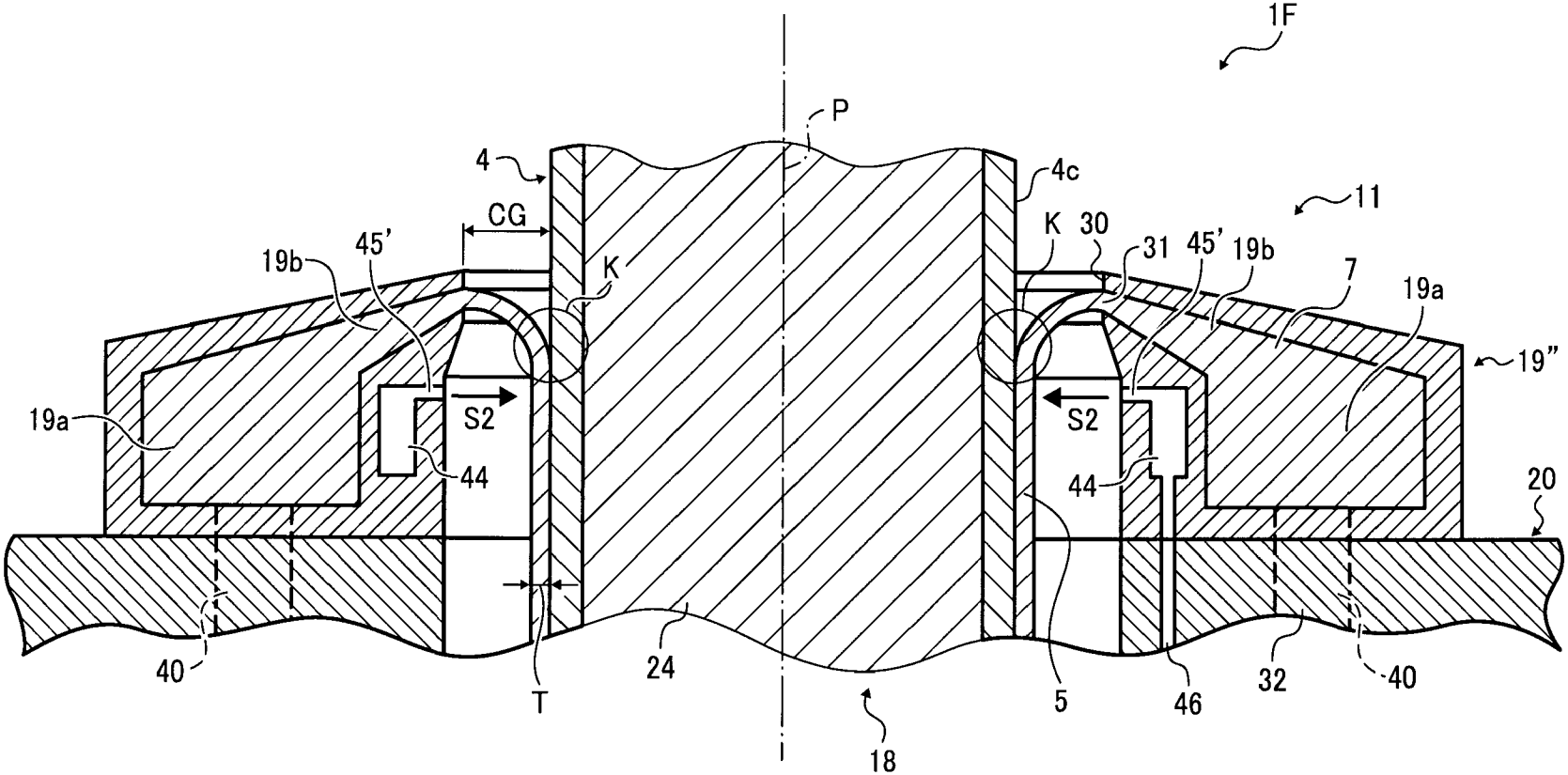
FIG. 9 is a cross-sectional view of a main part of a coating film forming apparatus according to a comparative example 3 of the present invention.

FIG. 9 is a cross-sectional view of a main part of a coating film forming apparatus according to a comparative example 3 of the present invention. In this drawing, the same components already described in the embodiments 1, 2, 3, 4 and the comparative example 2 are given the same reference numerals, and the explanations thereof are not described in detail.

A coating film forming apparatus 1F according to the comparative example 3, as illustrated in FIG. 9, has a structure of the coating film forming apparatus 1A explained in the embodiment 1, having the applying nozzle 19" having the second slit 45' instead of the second slit 45. This second slit 45' is formed throughout a circumference of the applying nozzle 19". This applying nozzle 19" discharges the gas supplied from the gas supply unit 47 through the second slit 45' to the paint 7 adhered to the outer circumferential face 4*c* of the base body 4. (A discharging direction of the gas is illustrated as an arrow 82 in FIG. 9.) In other words, the applying nozzle 19" discharges the gas to a downstream position farther away from the slit 19*b* than a contact position K (illustrated in FIG. 9) with the outer circumferential face 4*c* of the curtain film. In this case, the applying nozzle 19" evenly discharges the gas throughout the whole circumference (If the base body 4.

Next, tests 1 to 3 as follows were performed for the embodiments 1 to 4 and for the comparative examples 1 to 3.

(Test 1)

In the test 1, the coating film forming apparatus 1A according to the embodiment 1, the coating film forming apparatus (not illustrated) according to the comparative example 1, and the coating film forming apparatus 1E according to the comparative example 2 were used. The paint 7, the viscosity thereof being 30 Pa·s, was used. The base body 4, which had a cylindrical shape, a 60-mm diameter and a 90-μm thickness, and was structured by polyimide, was used. The thickness T of the elastic layer 3 was set to 200 μm and the interval CG between the applying nozzle 19 or 19' and the base body 4 was set to 350 μm. The movement speed of the applying nozzle supporting plate 32, i.e. the movement speed of the applying nozzle 19 or 19' was also set to 50 mm/s. Each coating film forming apparatus applied the paint 7 to 50 base bodies 4 for each. After applying the paint 7 was over, the formed coating film was hardened by heat and the elastic layer 5 was formed. And the following were tested.

(a) An evenness along an axial core direction in a position facing the gas discharging nozzle 42 of the elastic layer 5 formed by the coating film forming apparatus according to the comparative example 1.

(b) An evenness throughout a whole circumference of the elastic layer 5 formed by the coating film forming apparatus according to the comparative example 1.

(c) An evenness along an axial core direction in a position facing the gas discharging nozzle 42 of the elastic layer 5 formed by the coating film forming apparatus 1E according to the comparative example 2.

(d) An evenness throughout a whole circumference of the elastic layer 5 formed by the coating film forming apparatus 1E according to the comparative example 2.

(e) An evenness along an axial core direction in a position equivalent to a position facing the gas discharging nozzle 42 of the elastic layer 5 formed by the coating film forming apparatus 1A according to the embodiment 1.

(f) An evenness throughout a whole circumference of the elastic layer 5 formed by the coating film forming apparatus 1A according to the embodiment 1.

And results, which were determined to be unsuitable for practical use, are described in Table 1,

TABLE 1

| | EMBODIMENT 1 | COMPARATIVE EXAMPLE 1 | COMPARATIVE EXAMPLE 2 |
|---|---|---|---|
| EVENNESS ALONG AXIAL CORE DIRECTION | 0/50 BASE BODIES | 8/50 BASE BODIES | 0/50 BASE BODIES |
| EVENNESS THROUGHOUT WHOLE CIRCUMFERENCE | 0/50 BASE BODIES | 12/50 BASE BODIES | 50/50 BASE BODIES |

According to the Table 1, regarding the evenness along the axial core direction of the elastic layer 5, the comparative example 2 was better than the comparative example 1. This indicates that an influence of an entrained air flow, which occurs with applying the paint 7, can be restrained by the gas discharged from the gas discharging nozzle 42 and the curtain film forms a stable coating film. In addition, regarding the evenness throughout the whole circumference or the elastic layer 5, the embodiment 1 was the most excellent. The reason that the evenness throughout the whole circumference of the elastic layer 5 of the comparative example 2 was not good is that the gas discharging nozzle 42 was placed in one place, and thereby the influence on the curtain film by discharging of the gas was not even throughout the whole circumference.

(Test 2)

Figure 10:
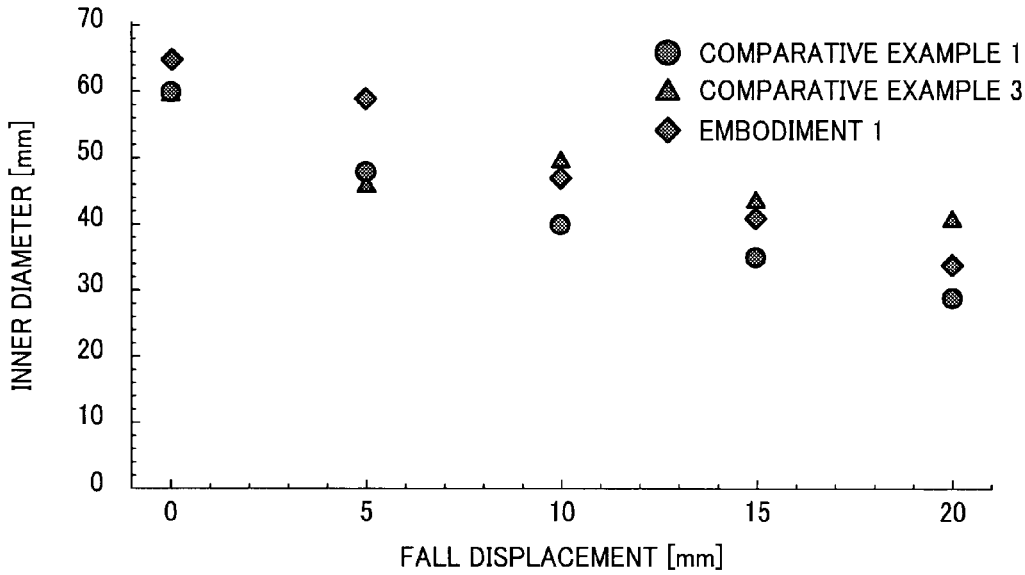
FIG. 10 is a graph which indicates a result of a test 2 to evaluate an effect of the present invention.

In the test 2, the coating film forming apparatus 1A according to the embodiment 1, the coating film forming apparatus (not illustrated) according to the comparative example 1, and the coating film forming apparatus 1F according to the comparative example 3, were used. The paint 7, the viscosity thereof being 30 Pa·s, was used. In a state that there was no base body 4, the thickness T of the elastic layer 5 and the interval CG between the applying nozzle 19 or 19' and the base body 4 were virtually set to 200 μm and 350 μm, respectively. (Both values were the same as when the base body 4, which had a cylindrical shape, a 60-mm diameter and a 90-μm thickness, was used.) The curtain film, which was formed by discharging the paint 7 from the slit 19*b*, was photographed from above in the vertical direction by a high-speed camera, and an inner diameter of the curtain film in an arbitrary point was examined. In the test 2, the state was that there was no base body 4. Because of this, a gas discharging direction of a comparative example 3 was virtually set to be a position which was 10 mm below the discharging hole 31 in a vertically down direction. Results are described as a graph in FIG. 10. In the graph of FIG. 10, a vertical axis describes an inner diameter, and a horizontal axis describes a fall displacement of the paint 7 from the discharging hole 31.

According to the graph of FIG. 10, the comparative example 1 can be said to be a general curtain film having a conic shape. In the comparative example 3, the inner diameter can be said to be significantly increasing in a 10 mm-fall-displacement position in which is a gas discharging position. Additionally, in the embodiment 1, compared to the comparative examples 1 and 3, the inner diameter of the curtain film can be said to be larger in an arbitrary fall position. Also in the comparative example 3, the inner diameter of the curtain film is larger in a position below the gas discharging position. However, in an actual applying, it is a position that applying to the base body 4 is already over, so that the result described above can not be obtained. From the mentioned above, the gas discharging is performed directly to the curtain film, and thereby it was obvious that the displacement from the discharging portion 31 in a cross section of the curtain film can be changed. This indicates that it is possible to change a range of forming the curtain film by the gas discharging.

(Test 3)

Figure 11:
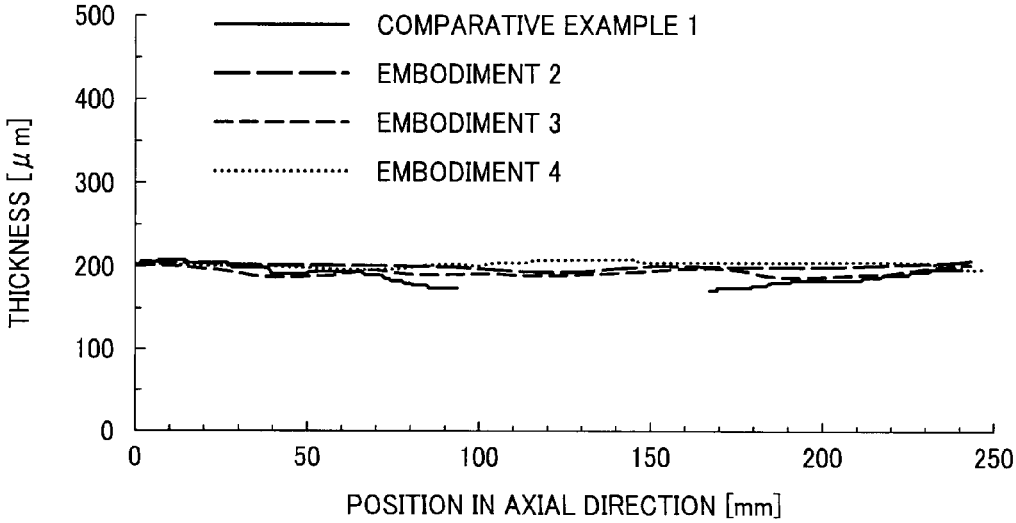
FIG. 11 is a graph which indicates a result of a test 3 to evaluate an effect of the present invention.

In the test 3, the coating film forming apparatus 1B according to the embodiment 2, the coating film forming apparatus 1C according to the embodiment 3, the coating film forming apparatus 1D according to the embodiment 4, and the coating film forming apparatus (not illustrated) according to the comparative example 1, were used. The paint 7, the viscosity thereof being 30 Pa·s, was used. A base body (not illustrated), which had an hourglass shape (an inverted-crown shape), in which a center part in the axial core direction (125 mm in the neighborhood from the bottom part), a smallest diameter of a constricted part was 100 μm, and had a 60 mm diameter, was used. A targeting thickness T of the elastic layer 5 and the interval CG between the applying nozzle 19 or 19' and the base body (i.e. the interval CG between the outer circumferential face in both edge parts in the axial core direction of the base body and the inner circumferential face 30 of the applying nozzle 19 or 19') were set to 200 μm and 350 μm, respectively. And the movement speed of the applying nozzle supporting plate 32, i.e. the movement speed of the applying nozzle 19 or 19' Was set to 50 mm/s. Each coating film forming apparatus applied the paint 7 to the base body. After applying the paint 7 was over, the formed coating film was hardened by heat and the elastic layer 5 was formed. In the coating film forming apparatuses 1B, 1C and 1D, a gas (gas or air) flow quantity discharging from the second slit 45 in the center part in the axial core direction of the base body was adjusted to be the biggest and the applying was performed. A measuring result of the thickness T of the formed elastic layer 5 is described as a graph of FIG. 11. In the graph of FIG. 11, a vertical axis describes the thickness T of the elastic layer 5 (unit: μm), and a horizontal axis describes a measurement position of the elastic layer 5 in the axial core direction (a bottom part is set to 0 mm.)

According to the graph of FIG. 11, it can be said that the comparative example 1 could not form a continuous film in the center part of the base body (a neighborhood position which had the smallest diameter of the constricted part). On the other hand, it can be said that the embodiments 2, 3 and 4 could form the continuous film throughout a whole area in the axial core direction, including the center pad which had the smallest diameter of the constricted part. The reason that the continuous film was not formed in the comparative example 1 is that the interval CG became too big in the neighborhood of the center part which had the smallest diameter of the constricted part, and was out of the range of forming the curtain film. On the other hand, the embodiments 2, 3, and 4 indicate that in the neighborhood of the center part which had the smallest diameter of constricted part, the gas flow quantity discharged from the second slit 45 was controlled, the discharging direction of the paint 7 was changed according to a change of a diameter of the constricted part, i.e. a change of a diameter along the axial core direction, and the paint 7 was applied within the range of forming the curtain film.

From the mentioned above, regarding the embodiments 2, 3 and 4, if a base body has a shape in which a diameter varies along the axial core direction, it is obvious that the coating film forming apparatuses 1B, 1C and 1D can stably form a coating film.

In addition, in the embodiments 1 to 4, it is described that the elastic layer 5 of the fixing roller 2 is formed, however it is needless to say that the coating film may be formed not only on the fixing roller 2 but also on various objects to be coated.

In the embodiments 1 to 4, the base body 4 is fixed and the applying nozzle 19 is moved. However, the applying nozzle 19 may be fixed and the base body 4 may be moved. And also both the applying nozzle 19 and the base body 4 may be moved.

In the embodiments 1 to 4, the gas is discharged obliquely from the lower pan to the upper part in the vertical direction and from the external side to the internal side in the circumferential direction of the applying nozzle 19, to the curtain film. However, the gas may be discharged obliquely from the upper part to the lower part in the vertical direction and from the internal side to the external side in the circumferential direction of the applying nozzle 19, and also may be discharged from both the internal side and the external side in the circumferential direction of the applying nozzle 19, to the curtain film.

For example, according to the embodiments described above, the following effects are also obtained.

The paint discharged from the applying nozzle can make contact with a position on the object to be coated which is a more internal or external side in the circumferential direction of the applying nozzle, than a position where the paint falls by its own weight. And thereby, it is possible to provide a coating film forming apparatus which easily forms the coating film having an even thickness and widely corresponds to many kinds of base bodies having different diameters.

It is possible to change a discharging direction of the paint by changing a movement speed of the piston and changing a flow quantity of the gas which is discharged.

It is possible to change the discharging direction of the paint by changing the flow quantity of the gas which is sent from the pressurized gas supply source.

It is possible to change the discharging direction of the paint by moving the shutter member, changing an opening area of the second slit and changing the flow quantity of the gas which is discharged.

It is possible to provide a coating film forming apparatus which can easily form an even-thickness coating film on a coated member, in which a diameter varies along an axial core direction.

It is possible to provide an electrophotographic fixing member having the even-thickness coating film at low cost.

It is possible to provide an image forming apparatus at low cost, by which the fixing image quality is good, shortens a start-up time of the electrophotographic fixing member, and contributes to an energy saving, because the image forming apparatus has the low-cost electrophotographic fixing member having the even-thickness coating film.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A coating film forming apparatus, which applies a paint to an outer circumferential face of an object to be coated to form a coating film, the coating film forming apparatus, comprising:

a retention section which retains the object to be coated in a state in which the outer circumferential face is exposed and in which an axial core of the object to be coated is in parallel with a vertical direction;

an applying nozzle formed in an annular shape, arranged to oppose the outer circumferential face and to have an interval therebetween, and coaxially arranged with the object to be coated retained by the retention section, the applying nozzle having a first slit which discharges the paint throughout a whole circumference of an inner circumferential face thereof;

a movement section which relatively moves the retention section and the applying nozzle along the axial core;

a paint supply section which supplies the paint to the applying nozzle; and a gas discharger including:

a gas supply section which supplies a gas;

a gas storage room which stores the gas supplied from the gas supply section; and a second slit which discharges the gas in the gas storage room towards the paint discharged in a conic shape from the first slit, evenly throughout a whole circumference in a circumferential direction of the discharged paint, to change a discharging direction of the paint.

2. A coating film forming apparatus according to claim 1, wherein the gas supply section is a piston arranged movably in the gas storage room, the piston being configured to move towards the second slit to discharge the gas stored in the gas storage room from the second slit, the gas storage room is formed in an annular shape throughout the whole circumference of the applying nozzle, and the second slit communicates with the gas storage room and is opened throughout the whole circumference of the inner circumferential face of the applying nozzle.

3. A coating film forming apparatus according to claim 1, wherein the gas supply section includes a pressurized gas supply source which sends the gas in a pressurized state to the gas storage room, the gas storage room is formed in an annular shape throughout the whole circumference of the applying nozzle, and the second slit communicates with the gas storage room and is opened throughout the whole circumference of the inner circumferential face of the applying nozzle.

4. A coating film forming apparatus according to claim 3, wherein the gas discharger further comprises a shutter member formed in an annular shape along the inner circumferential face of the applying nozzle, and which moves along a direction of the axial core to change an opening area of the second slit.

5. A coating film forming apparatus according to claim 4, further comprising a control section configured to:

discharge the paint from the first slit of the applying nozzle which is in a state of opposing one end part of the object to be coated retained by the retention section;

control the movement section and the paint supply section such that the applying nozzle is relatively moved towards another end part of the object to be coated while the paint is discharged from the first slit; and control a gas flow quantity of the gas discharged by the gas discharger according to a change of an interval between the outer circumferential face of the object to be coated and the inner circumferential face of the applying nozzle.

6. A coating film forming apparatus according to claim 3, further comprising a control section configured to:

discharge the paint from the first slit of the applying nozzle which is in a state of opposing a one end part of the object to be coated retained by the retention section;

control the movement section and the paint supply section such that the applying nozzle is relatively moved towards another end part of the object to be coated while the paint is discharged from the first slit; and control a gas flow quantity discharged by the gas discharger according to a change of an interval between the outer circumferential face of the object to be coated and the inner circumferential face of the applying nozzle.

7. A coating film forming apparatus according to claim 1, further comprising a control section configured to:

discharge the paint from the first slit of the applying nozzle which is in a state of opposing a one end part of the object to be coated retained by the retention section;

control the movement section and the paint supply section such that the applying nozzle is relatively moved towards another end part of the object to be coated while the paint is discharged from the first slit; and control a gas flow quantity discharged by the gas discharger according to a change of an interval between the outer circumferential face of the object to be coated and the inner circumferential face of the applying nozzle.

8. A coating film forming apparatus according to claim 1, wherein the applying nozzle includes a paint storage room arranged in a circumferential direction of the applying nozzle relative to the gas storage room.

9. A coating film forming apparatus according to claim 1, further comprising:

a controller connected to the gas supply section and configured to control a quantity of the gas supplied from the gas supply section.

10. A coating film forming apparatus according to claim 1, further comprising:

a controller connected to the paint supply section and configured to control the paint supply section to supply the paint to the applying nozzle.

11. A coating film forming apparatus according to claim 1, further comprising:

a controller connected to the movement section and configured to control the movement section to move the applying nozzle a specific distance in a specific direction, relative to the object to be coated.

12. A coating film forming apparatus according to claim 2, further comprising a control section configured to:

discharge the paint from the first slit of the applying nozzle which is in a state of opposing a one end part of the object to be coated retained by the retention section;

control the movement section and the paint supply section such that the applying nozzle is relatively moved towards another end part of the object to be coated while the paint is discharged from the first slit; and control a gas flow quantity discharged by the gas discharger according to a change of an interval between the outer circumferential face of the object to be coated and the inner circumferential face of the applying nozzle.

* * * * *